US007819227B2

(12) United States Patent
Rutschmann et al.

(10) Patent No.: US 7,819,227 B2
(45) Date of Patent: Oct. 26, 2010

(54) INTERNAL COMBUSTION ENGINE WITH PRESSURE LUBRICATION BY THE DRY SUMP PRINCIPLE

(75) Inventors: Erwin Rutschmann, Tiefenbronn (DE); Thorsten Wieg, Pforzheim (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 375 days.

(21) Appl. No.: 10/592,931

(22) PCT Filed: Apr. 15, 2005

(86) PCT No.: PCT/EP2005/003992

§ 371 (c)(1),
(2), (4) Date: Sep. 15, 2006

(87) PCT Pub. No.: WO2006/000269

PCT Pub. Date: Jan. 5, 2006

(65) Prior Publication Data

US 2008/0245613 A1 Oct. 9, 2008

(30) Foreign Application Priority Data

Jun. 23, 2004 (DE) ..... 10 2004 030 353

(51) Int. Cl.
*F01M 1/04* (2006.01)
*F01M 13/06* (2006.01)

(52) U.S. Cl. ..... 184/6.5; 184/6.13; 123/196 R

(58) Field of Classification Search ..... 123/41.42, 123/41.74; 184/6.5, 6.13, 6.21, 6.22, 106
See application file for complete search history.

(56) References Cited

U.S. PATENT DOCUMENTS

| | | | | |
|---|---|---|---|---|
| 2,073,096 A | | 3/1937 | Church | |
| 2,079,357 A | | 5/1937 | Morris et al. | |
| 2,443,875 A | * | 6/1948 | Spangenberger | 123/196 A |
| 2,575,315 A | * | 11/1951 | Edwards | 123/196 A |
| 2,974,652 A | | 3/1961 | Benzinger | |
| 4,440,117 A | | 4/1984 | Buchmueller | |

(Continued)

FOREIGN PATENT DOCUMENTS

DE 36 39 691 A1 1/1988

(Continued)

OTHER PUBLICATIONS

German Search Report with English translation dated Oct. 18, 2005 (Thirteen (13) Pages).

(Continued)

*Primary Examiner*—John Q Nguyen
*Assistant Examiner*—Robert T Reese
(74) *Attorney, Agent, or Firm*—RatnerPrestia

(57) ABSTRACT

An internal combustion engine having pressure lubrication according to the dry sump principle, in particular for an opposed cylinder engine, has a crankcase in which an oil suction space (dry sump) is formed in the lower part. The lubricant oil is conveyed from the oil suction space to an oil supply container (wet sump) via an oil return pump equipped with an oil suction line. The lubricant oil in the oil supply tank and/or in the oil supply space is conveyed to the consumer via a main delivery pump. An annular space arranged around the cylinder is provided as part of the oil returned to the oil supply tank.

9 Claims, 2 Drawing Sheets

U.S. PATENT DOCUMENTS

| | | | | |
|---|---|---|---|---|
| 4,674,457 | A | 6/1987 | Berger et al. | |
| 4,813,408 | A * | 3/1989 | Katsumoto et al. | 123/196 AB |
| 4,815,419 | A * | 3/1989 | Kitada et al. | 123/41.42 |
| 4,825,825 | A | 5/1989 | Chino et al. | |
| 4,834,030 | A | 5/1989 | Bauer et al. | |
| 4,915,070 | A | 4/1990 | Okui | |
| 5,215,316 | A * | 6/1993 | Udagawa | 277/595 |
| 5,333,575 | A * | 8/1994 | Olmr | 123/41.42 |
| 5,572,968 | A | 11/1996 | Esch et al. | |
| 5,842,447 | A * | 12/1998 | Krotky et al. | 123/41.28 |
| 6,142,129 | A | 11/2000 | Hori et al. | |
| 6,578,541 | B2 * | 6/2003 | Stromsky et al. | 123/196 R |
| 6,823,968 | B2 * | 11/2004 | Baeumler | 184/106 |
| 6,889,651 | B2 * | 5/2005 | Tanaka et al. | 123/196 R |
| 7,240,657 | B2 * | 7/2007 | Watanabe | 123/196 R |
| 2003/0042078 | A1 | 3/2003 | Baeumler | |
| 2003/0140888 | A1 * | 7/2003 | Tanaka et al. | 123/196 R |
| 2004/0031636 | A1 | 2/2004 | Pichler et al. | |

FOREIGN PATENT DOCUMENTS

| | | | |
|---|---|---|---|
| DE | 198 37 099 | C1 | 10/1999 |
| DE | 10014368 | | 10/2001 |
| DE | 10029844 | | 1/2002 |
| DE | 100 53 096 | A1 | 5/2002 |
| DE | 101 39 709 | A1 | 2/2003 |
| EP | 0 335-246 | A2 | 10/1989 |
| EP | 1 079 080 | A2 | 2/2001 |

OTHER PUBLICATIONS

German Office Action with English translation dated Apr. 22, 2005 (Eight (8) Pages).
International Search Report with English translation of relevant portion Dated Oct. 19, 2005 (Eleven (11) Pages).
German Office Action Dated Apr. 12, 2005 (Four (4) Pages).

* cited by examiner

INTERNAL COMBUSTION ENGINE WITH PRESSURE LUBRICATION BY THE DRY SUMP PRINCIPLE

BACKGROUND AND SUMMARY OF THE INVENTION

The present invention relates to an internal combustion engine with pressure lubrication according to the dry sump principle, in particular for an opposed-cylinder engine.

With today's water-cooled six-cylinder opposed-cylinder engines of the 911 Carrera model series (Dr. Ing. h.c. F. Porsche A G), an oil bulkhead tank in which the oil sump for the lubricating oil supply to the engine is formed is provided in the oil carrying casing and/or in the oil pan. The oil lubricant recycled by the various consumers back to the oil pan is first returned outside of the oil bulkhead tank forming the oil suction space before entering the actual oil suction space through openings monitored by valves in the oil bulkhead tank.

In engines with dry sump lubrication, the oil flowing back into the oil pan is conveyed by a suction pump into a separate oil tank or oil supply container from which the pressure oil delivery pump sucks out the lubricant and forces it to the lubrication points through filters and oil coolers, if necessary. In most cases the oil tank is mounted on the outside of the crankcase and has corresponding connections for the oil pressure lines laid externally.

An object of the present invention is to provide a low-friction driving gear with dry sump pressure lubrication for high-speed operation in particular to increase the specific power of an internal combustion engine; in this type of operation, the components required for pressure lubrication of the internal combustion engine are largely integrated into the engine in a space-saving manner.

This object has been achieved according to this invention by providing an annular space around the cylinders as part of the oil return to the oil supply container.

According to this invention, a portion of the oil be recycled into the oil supply container and/or into the wet sump space through the annular spaces.

In particular, with cylinder crankcases of the open-deck configuration in which the water jacket is provided only in the upper part of the cylinder, there remains an annular space which is open toward the crankcase space and which can be used as part of the oil return line into the wet sump with an appropriate seal at the end. A gland made of, for example, plastic may be provided as the seal for the annular space.

When the (wet sump) oil-collecting space is arranged beneath the annular spaces provided for the oil return and/or integrated into the crankcase, the lubricating oil can be transferred directly from the annular space into the oil-collecting space(s). It is thus now possible to largely eliminate external oil lines so that this measure contributes to a compact and inexpensive implementation of an internal combustion engine with dry sump lubrication.

On the basis of the horizontal arrangement of cylinders in an opposed-cylinder engine, the annular spaces which are used for the lubricating oil return can be vented toward the top and the lubricating oil can be defoamed.

Other objects, advantages and novel features of the present invention will become apparent from the following detailed description of the invention when considered in conjunction with the accompanying drawings.

DETAILED DESCRIPTION OF THE DRAWINGS

Figure 1:
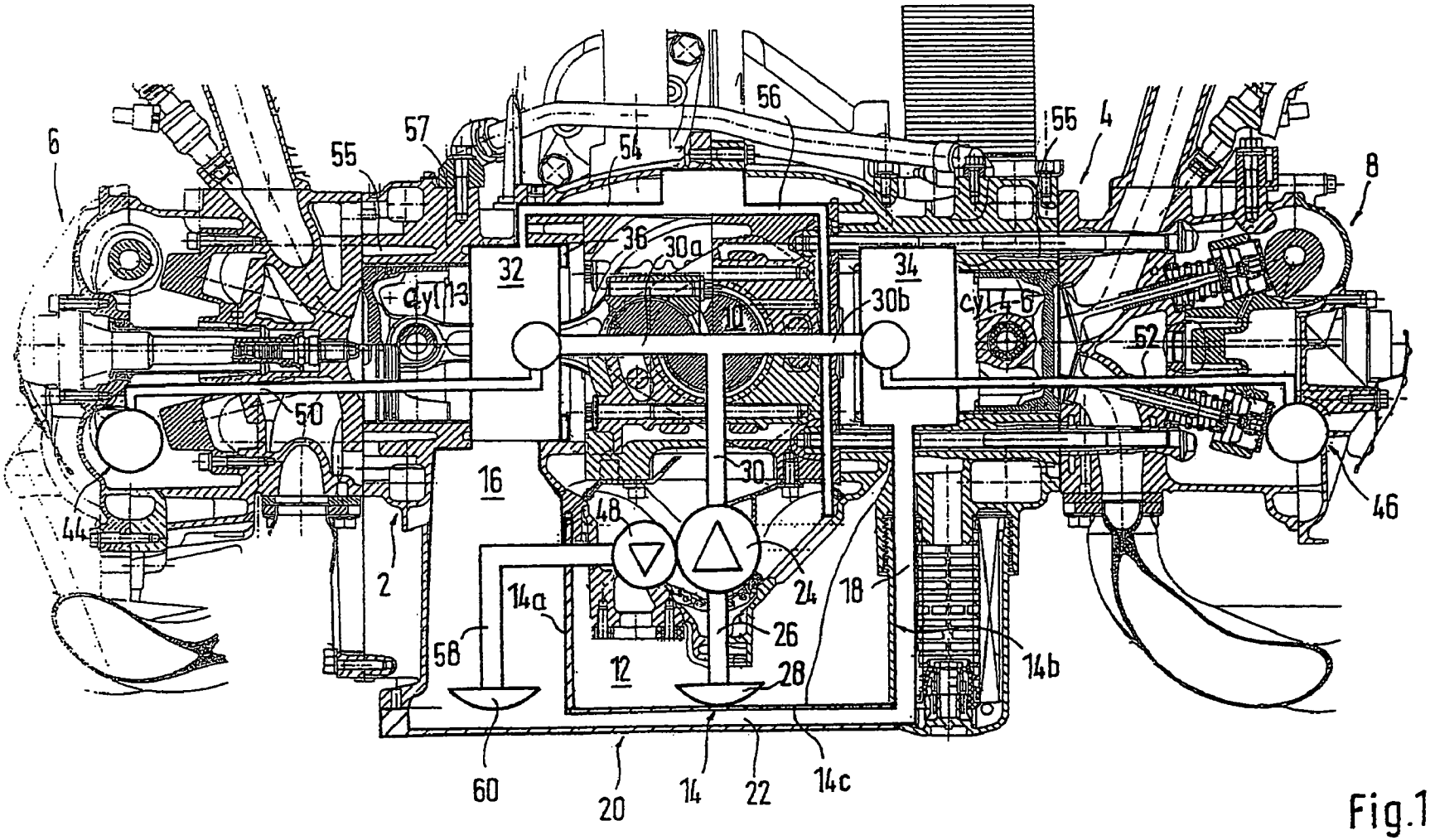
FIG. 1 is a cross-section view of a dry sump oil circulation of an internal combustion engine.

FIG. 1 shows the principle of a dry sump oil circulation system, which is not intended to be limited to this particular illustrated embodiment, for a six-cylinder opposed-cylinder engine, the parts of which that are necessary only for a description of the oil circulation are described in greater detail below with reference to the figures. The engine has two crankcase halves 2, 4; a cylinder bank row "1" through "3" and "4" through "6" is arranged in each half. A cylinder head 6, 8 in which the valve drive required for operating the intake and exhaust valves is arranged is connected to each of the two cylinder bank rows. Beneath the bearing for the crankshaft 10, the crankcase 2, 4 has an oil suction space 12 (dry sump) in which the oil lubricant provided for lubrication of the bearings is collected. Oil return bores (not shown) are integrated into the engine, ensuring that the oil lubricant is returned to the oil suction space 12 in a targeted manner.

The dry sump oil suction space 12 is bordered by an oil bulkhead tank 14 with (wet sump) collecting spaces 16, 18 adjacent to the two side walls 14*a*, 14*b* thereof The two collecting spaces 16, 18 are interconnected by an interspace 22 which is formed between the lower wall 14*c* of the oil bulkhead tank 14 and an oil pan cover 20. An oil return pump 24 provided for the dry sump pressure lubrication has an oil suction line 26 connected to its intake end leading into the oil suction space 12. An oil suction snorkel 28 which is attached to the end of the oil suction line 26 is arranged in the area of the lower wall 14*c* of the oil bulkhead tank 14. A line 30 is connected to the pressure side of the oil return pump 24 and leads as a branch line 30*a* or 30*b* to annular spaces 32, 34, respectively, surrounding the cylinders "1" through "3" and "4" through "6".

Figure 2:
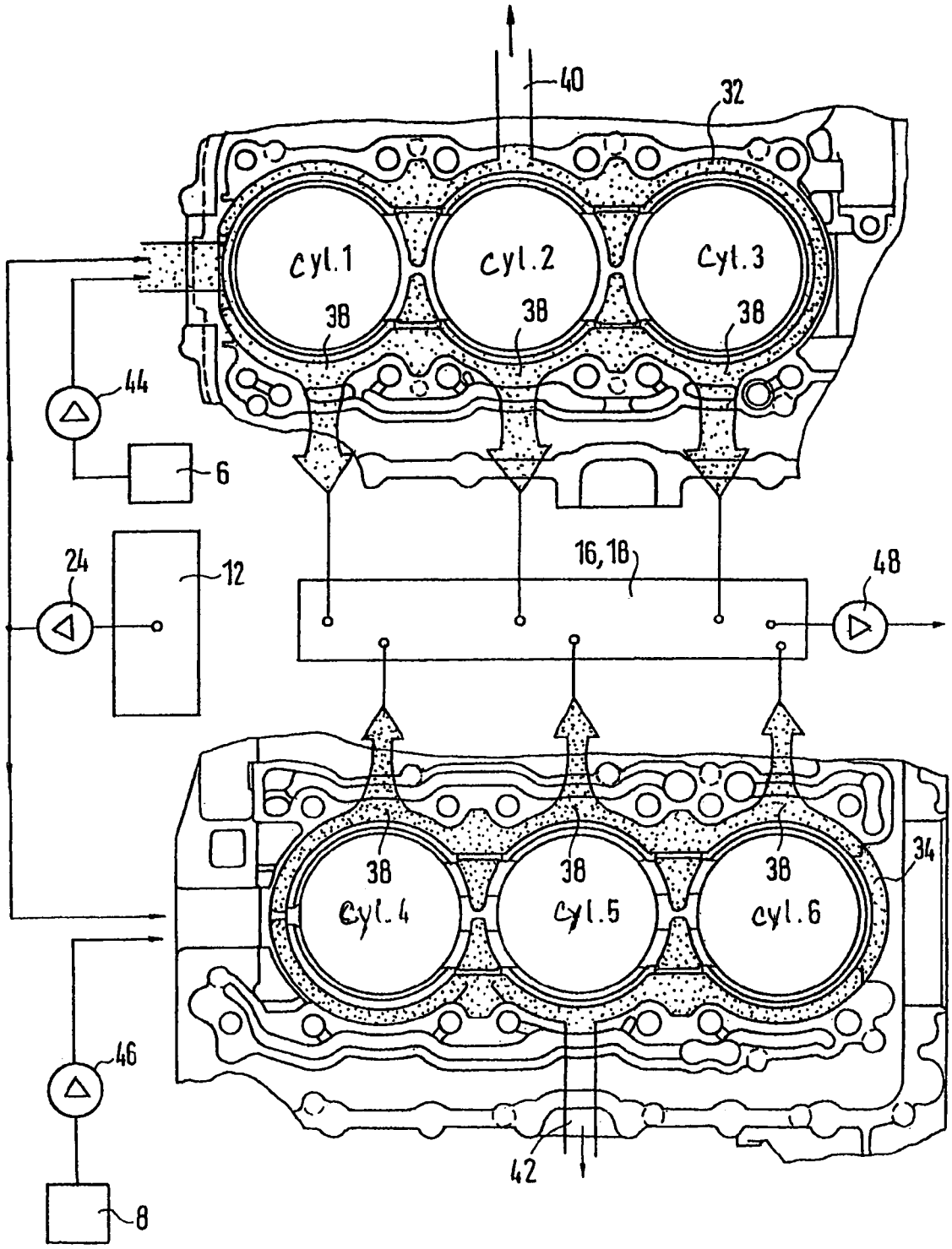
FIG. 2 is a basic view of the oil return in the area of the cylinders for the engine shown in FIG. 2.

The two annular spaces 32, 34 are each sealed by a gasket 36 (shown only in the left crankcase half 2), e.g., in the form of a plastic gland, on the end face which faces the crank[case] space. As FIGS. 1 and 2 show, the annular spaces 32, 34 have openings 38 and/or passages on their lower lateral surfaces that are connected to the (wet sump) collecting spaces 16, 18. The middle cylinder of each of the two cylinder bank rows Zyl.1-3 and Zyl.4-6 has a vent connection 40, 42, which is connected to the top side of the annular spaces 32, 34 (at the top in relation to the installed position of the cylinder). On the basis of this shape of the oil return, it is possible to largely omit any externally installed oil lines. The oil lubricant can be defoamed via the annular spaces 32, 34 and air and/or gas components can be discharged to the outside through the vent connections 40, 42 so that separate oil/air separators are not needed.

As shown in FIG. 1, the wet sump collecting spaces 16, 18 and the dry sump oil suction space 12 are vented through appropriate lines 54, 56. Likewise annular spaces 55 are provided in the upper area of the cylinders with coolant flowing through the annular spaces to cool the cylinders, and the annular spaces are separated from annular spaces 32, 34 by a peripheral web 57.

Suction pumps 44, 46 driven by the camshafts are provided in the two cylinder heads 6, 8 of the internal combustion engine, drawing the lubricant oil conveyed by a main delivery pump 48 into the cylinder heads 6, 8 and returning it via lines 50, 52 and the annular spaces 32, 34 to the (wet sump) collecting spaces 16, 18.

The main delivery pump 48 is driven by an intermediate shaft (not shown in detail), and an oil suction line 58 is connected to its intake side and leads into the oil-collecting space 16. An oil suction snorkel 60 which is placed near the oil pan cover 20 is also attached to the end of the oil suction line 58. Oil supply lines (not shown in detail here) integrated into the crankcase 2, 4 are connected to the pressure side of the main delivery pump 48 and lead to the consumers, e.g., the main bearing points of the crankshaft and the camshaft.

The invention claimed is:

1. Internal combustion engine having cylinder groups and using dry-sump-principle pressure lubrication, comprising:

a crankcase having a dry-sump oil suction space in a lower part thereof for collecting lubricant oil;

an oil return pump that is configured to convey lubricant oil out of the dry-sump oil suction space, through an oil suction line, and directly into an annular space arranged around cylinder groups, wherein the oil suction line of the oil return pump delivers lubricant oil directly into the annular space, and wherein the annular space is fluidly coupled to a vent connection that is exposed to the atmosphere for defoaming the lubricant oil collected within the annular space;

a wet-sump oil supply container that is fluidly coupled to the annular space for receiving defoamed lubricant oil from the annular space; and a main delivery pump configured for conveying lubricant oil from the wet-sump oil supply container directly to consumers of the lubricant oil, wherein the wet-sump oil supply container is separate from the dry-sump oil suction space and is positioned to at least partially surround the dry-sump oil suction space, at least a portion of the wet-sump oil supply container being disposed at an elevation beneath the dry-sump oil suction space.

2. Internal combustion engine according to claim 1, wherein the engine is an opposed-cylinder engine.

3. Internal combustion engine as claimed in claim 1, wherein the annular space is open to a crank space and is gasket-sealed.

4. Internal combustion engine as claimed in claim 1, wherein the wet-sump oil supply container is integrated into the crankcase.

5. Internal combustion engine as claimed in claim 4, wherein the wet-sump oil supply container is integrated into the crankcase so as to be separated from the dry-sump oil suction space by one or more bulkhead walls.

6. Internal combustion engine as claimed in claim 1, wherein the crankcase is of open deck configuration.

7. Internal combustion engine as claimed in claim 1, wherein the main delivery pump is configured to convey lubricant oil to a cylinder head of the engine.

8. Internal combustion engine as claimed in claim 7 further comprising a suction pump for delivering oil from the cylinder head of the engine directly into the annular space arranged around cylinder groups.

9. Internal combustion engine having cylinder groups and using dry-sump-principle pressure lubrication, comprising:

a crankcase having a dry-sump oil suction space in a lower part thereof for collecting lubricant oil, an oil return pump that is configured to convey lubricant oil out of the dry-sump oil suction space, through an oil suction line, and directly into an annular space arranged around cylinder groups, wherein the oil suction line of the oil return pump delivers lubricant oil directly into the annular space, and wherein the annular space is fluidly coupled to a vent connection that is exposed to the atmosphere for defoaming the lubricant oil collected within the annular space;

a wet-sump oil supply container that is fluidly coupled to the annular space for receiving defoamed lubricant oil from the annular space; and a main delivery pump configured for conveying lubricant oil from the wet-sump oil supply container directly to consumers of the lubricant oil.

* * * * *